US007000675B2

(12) United States Patent
Herron et al.

(10) Patent No.: US 7,000,675 B2
(45) Date of Patent: Feb. 21, 2006

(54) CHILL ASSEMBLY

(75) Inventors: Paul Herron, Livonia, MI (US); John N. Wuest, Northville, MI (US)

(73) Assignee: Tooling and Equipment International, Livonia, MI (US)

( * ) Notice: Subject to any disclaimer, the term of this patent is extended or adjusted under 35 U.S.C. 154(b) by 70 days.

(21) Appl. No.: 10/820,608

(22) Filed: Apr. 8, 2004

(65) Prior Publication Data

US 2004/0200596 A1 Oct. 14, 2004

Related U.S. Application Data

(60) Provisional application No. 60/461,663, filed on Apr. 9, 2003.

(51) Int. Cl.
*B22D 15/00* (2006.01)

(52) U.S. Cl. ..... 164/127; 164/355

(58) Field of Classification Search ..... 164/353, 164/355, 127

See application file for complete search history.

(56) References Cited

U.S. PATENT DOCUMENTS

| | | | | |
|---|---|---|---|---|
| 1,948,653 | A * | 2/1934 | Emery et al. | 164/346 |
| 3,598,167 | A | 8/1971 | Snyderman | |
| 3,752,221 | A | 8/1973 | Copley et al. | |
| 4,094,181 | A | 6/1978 | Westberg | |
| 4,763,716 | A | 8/1988 | Graham et al. | |
| 5,072,773 | A | 12/1991 | Ruff et al. | |
| 5,122,204 | A | 6/1992 | McDonald | |
| 5,704,412 | A | 1/1998 | Gurdebeke | |
| 5,836,374 | A | 11/1998 | Mai | |
| 5,904,203 | A | 5/1999 | Mai | |
| 6,378,835 | B1 | 4/2002 | Wakita et al. | |
| 6,464,198 | B1 * | 10/2002 | Hugo | 249/111 |
| 6,543,518 | B1 | 4/2003 | Bend et al. | |
| 6,578,623 | B1 | 6/2003 | Keller et al. | |
| 6,588,487 | B1 | 7/2003 | Crafton et al. | |
| 2002/0007931 | A1 | 1/2002 | Crafton et al. | |
| 2003/0000677 | A1 | 1/2003 | Arcelus et al. | |
| 2003/0217831 | A1 | 11/2003 | Arcelus et al. | |

* cited by examiner

*Primary Examiner*—Len Tran
(74) *Attorney, Agent, or Firm*—Howard & Howard

(57) ABSTRACT

A chill assembly for chilling a molten material during formation of a part is disclosed. The chill assembly includes an upper platform and a mold platform for receiving a mold package to be filled with the molten material to form the part. The upper platform has a first platen moveable in a vertical direction relative to the molding platform. A plurality of chills are moveably supported by the first platen for quenching the molten material. Each of the chills are moveable between a pre-chill position and a post-chill position. An alignment sub-assembly engages the chills and aligns the chills in the pre-chill position. The alignment sub-assembly re-aligns the chills after the chills have quenched the molten material and moved to the post-chill position. The alignment sub-assembly is capable of precisely aligning and re-aligning the chills after each successive quenching of the molten material.

26 Claims, 7 Drawing Sheets

CHILL ASSEMBLY

BACKGROUND OF THE INVENTION

1. Field of the Invention

The subject invention provides a chill assembly for chilling a molten material during formation of a part.

2. Description of the Related Art

Various related art assemblies disclose a chill for chilling, or quenching, a part during formation. These assemblies include a first platen driven by a lift to raise and lower the first platen. A mold package is positioned underneath the first platen and a liquid metal or other molten material is introduced into the package to form the part. The material is injected into the package and takes the form of the part. A chill extending from the first platen is brought into contact with the mold package and the liquid metal or molten material Related art assemblies generally disclose the chill as a rod extending the length of the first platen or the length of the mold package. The chill contacts the molten material in the mold package and begins to quench the molten material to form the part. The quenching of the part improves the properties of the part in the areas surrounding the chill.

However, when the molten material is chilled, the part shrinks inward from the ends toward a center of the part. These various assemblies do not allow for movement of the chills with the shrinkage of the part during cooling. Since the rod is fixed to the first platen, the chill becomes wet with the liquid metal. By wet it is meant that the chill becomes fixed to the part and must be removed from the first platen and travels with the part until it can be removed. This causes the process of forming the part to be very slow since the chill cannot be collected until after the part has finished processing. Alternately, these related art assemblies require that multiple chills be available to reattach to the first platen for the next successive part, while the previous chill is fixed in the part and prior to reclaiming it.

Therefore, it would be advantageous to provide an assembly that allowed for quenching of a molten material with a chill that was recoverable prior to completion of the part. Further, it would be advantageous to provide the assembly with a plurality of chills that are moveable to compensate for the shrinkage of the part during quenching and having a re-alignment mechanism to reposition the chills in a pre-chill position after quenching.

BRIEF SUMMARY OF THE INVENTION AND ADVANTAGES

The subject invention provides a chill assembly for chilling a molten material during formation of a part. The assembly includes a mold platform for receiving a mold to be filled with a molten material to form a part and a first platen moveable in a vertical direction relative to the molding platform. A plurality of chills are moveably supported by the first platen for quenching the molten material. Each of the chills are moveable between a pre-chill position prior to quenching and a post-chill position after quenching. An alignment sub-assembly engages the chills and aligns the chills in the pre-chill position after the chills have quenched the molten material and the chills have moved to the post-chill position.

The subject invention further provides a method of forming the part from molten material. The method comprises the steps of disposing the mold for the part on the mold platform adjacent the first platen. The plurality of chills are supported by the second platen and positioned in a pre-chill position relative to the mold. The molten material is injected into the mold and the first platen is moved into contact with the mold such that the chills quench the molten material as the molten material begins to cool to form the part. The plurality of chills moved along the X-direction simultaneously with a shrinkage occurring in the part as the molten material cools such that the chills end in a post-chill position. The first platen is then moved out of contact with the mold to remove the chills from the molten material and the plurality of chills are re-aligned from the post-chill position to the pre-chill position.

The subject invention overcomes the inadequacies that characterize the related art assemblies. Specifically, the subject invention provides an assembly that has a plurality of chills that are moveable between a pre-chill position and a post-chill position to compensate for shrinkage of the part during formation. Further, the subject invention provides an alignment sub-assembly for re-aligning the chills in the pre-chill position in preparation for molding the next part. One improved characteristic of the part formed according to the subject invention is increased strength in the desired area where the chill remains in contact with the part while shrinking.

BRIEF DESCRIPTION OF THE SEVERAL VIEWS OF THE DRAWINGS

Other advantages of the present invention will be readily appreciated as the same becomes better understood by reference to the following detailed description when considered in connection with the accompanying drawings wherein.

DETAILED DESCRIPTION OF THE INVENTION

Figure 1:
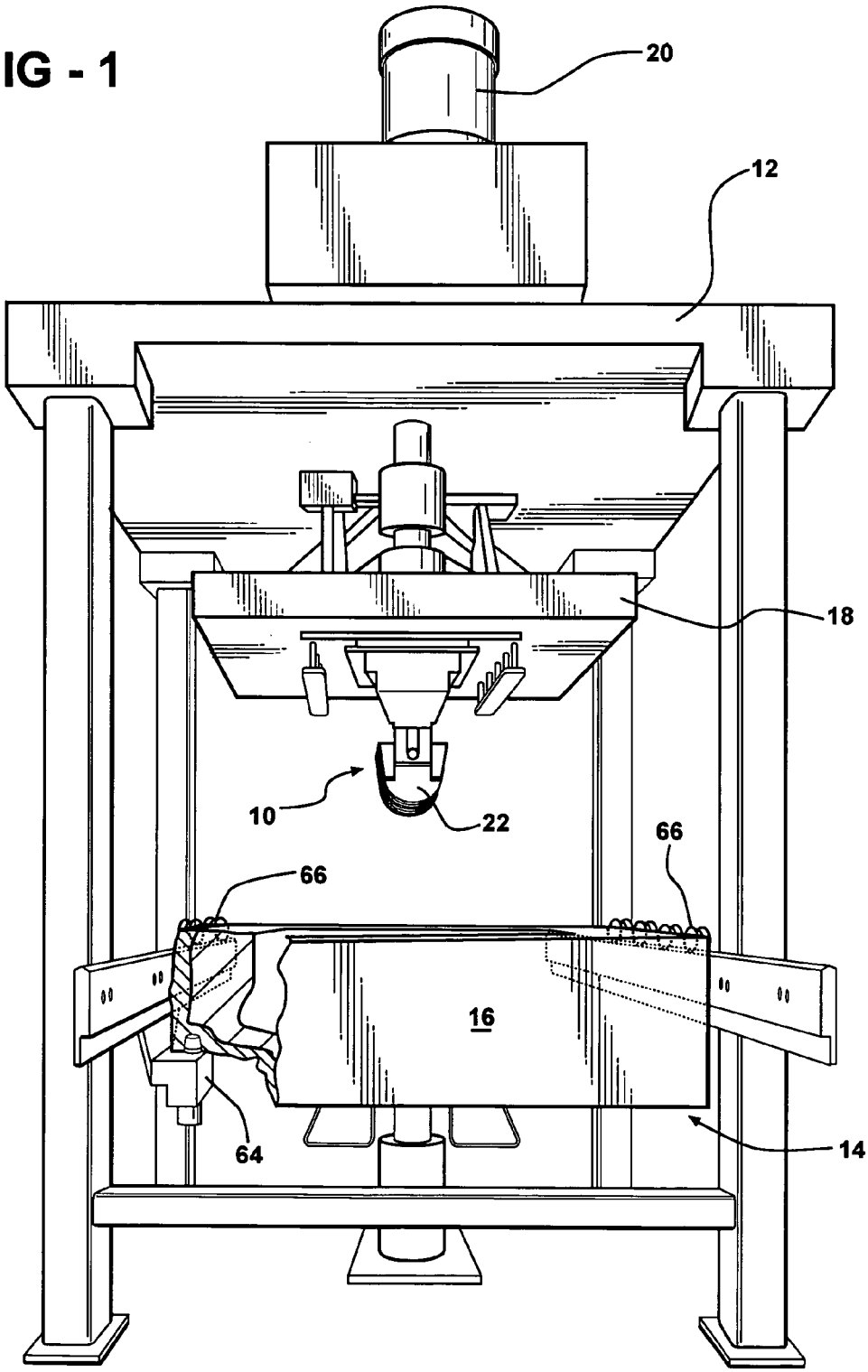
FIG. 1 is a perspective end view of a chill assembly having an upper platform and a mold platform spaced relative to one another for forming a part.

Referring to the figures, wherein like numerals indicate like or corresponding parts throughout the several views, a chill assembly for chilling a molten material during formation of a part 15 is shown generally at 10 in FIG. 1. The chill assembly 10 includes an upper platform 12 and a mold platform 14 for receiving a mold package 16 to be filled with the molten material to form the part 15. The mold package 16 is preferably a sand package; however, other packages may be used as is known by those skilled in the art. The mold package 16 has a material inlet (not shown) for receiving a molten, or fluidized, material, such as a liquid metal, which forms the part 15. It is to be appreciated that other types of material may be used with the subject invention, however, in one embodiment the material is molten aluminum. Typical parts 15 formed from the mold package 16 include engine blocks, cylinder heads, and any other parts 15 that require reinforced areas having improved strength.

The upper platform 12 has a first platen 18 moveable in a vertical direction relative to the molding platform. A lift 20 is in engagement with the first platen 18 for driving the first platen 18 upward and downward in the vertical direction. Preferably, the lift 20 is a hydraulic lift. However, it is to be appreciated, that other lifts are capable of use with the subject invention. The lift 20 may be supported on or adjacent the upper platform 12.

Figure 2:
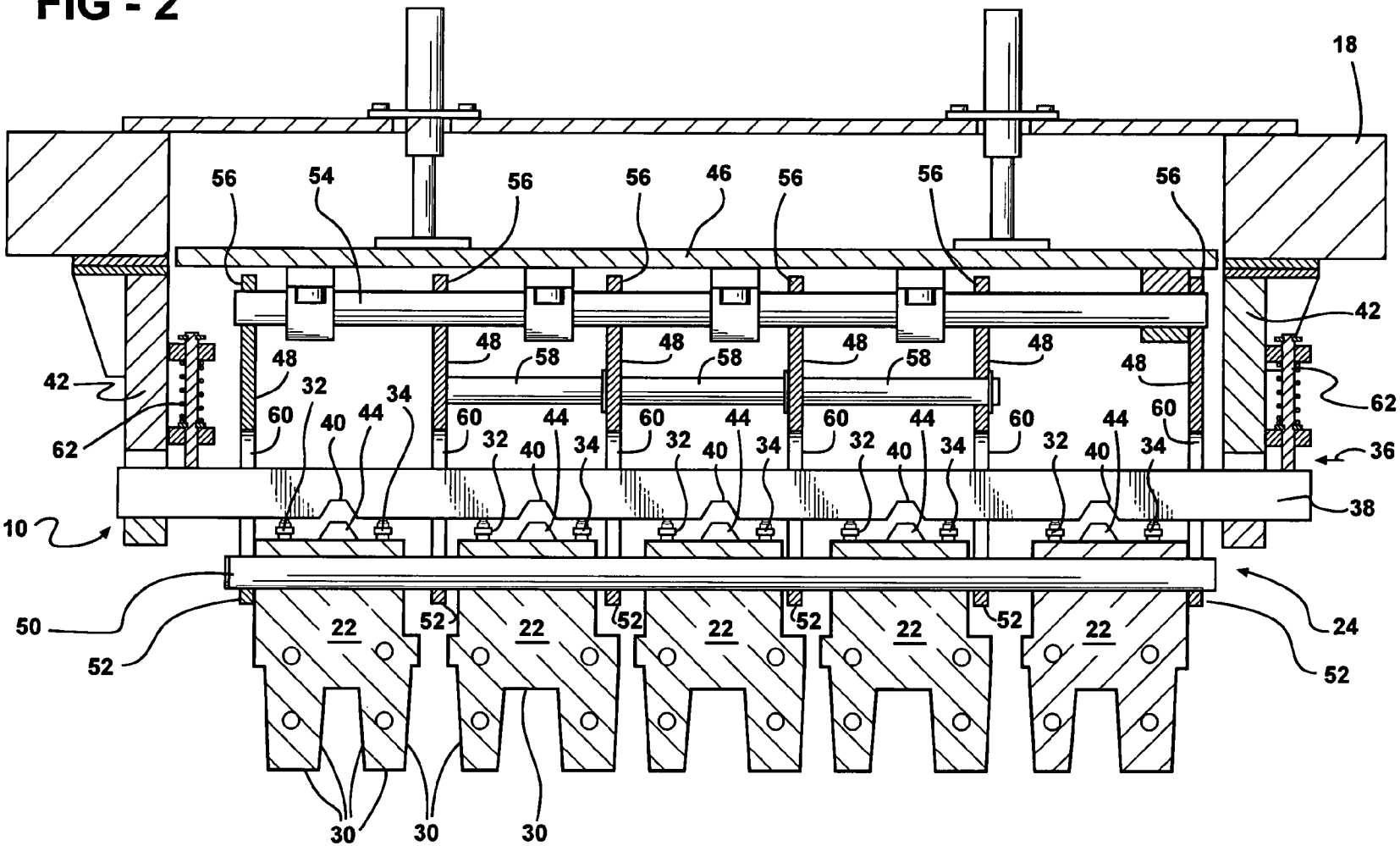
FIG. 2 is a cross-sectional view of the chill assembly taken along a center line having a plurality of chills in a pre-chill position.
Figure 3:
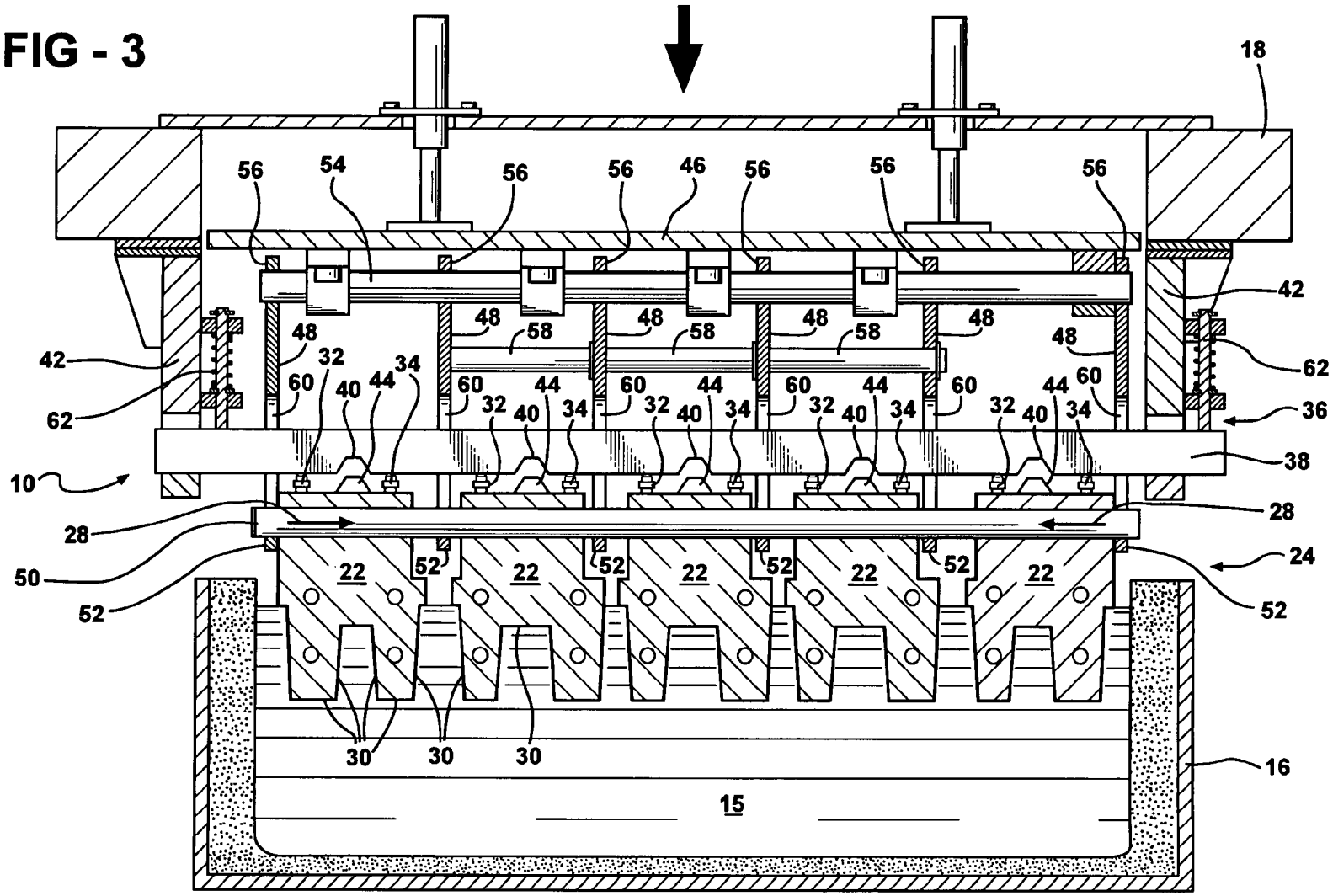
FIG. 3 is a cross-sectional view of the plurality of chills being brought into contact with a molten material to form the part such that the chills are still in the pre-chill position.
Figure 4:
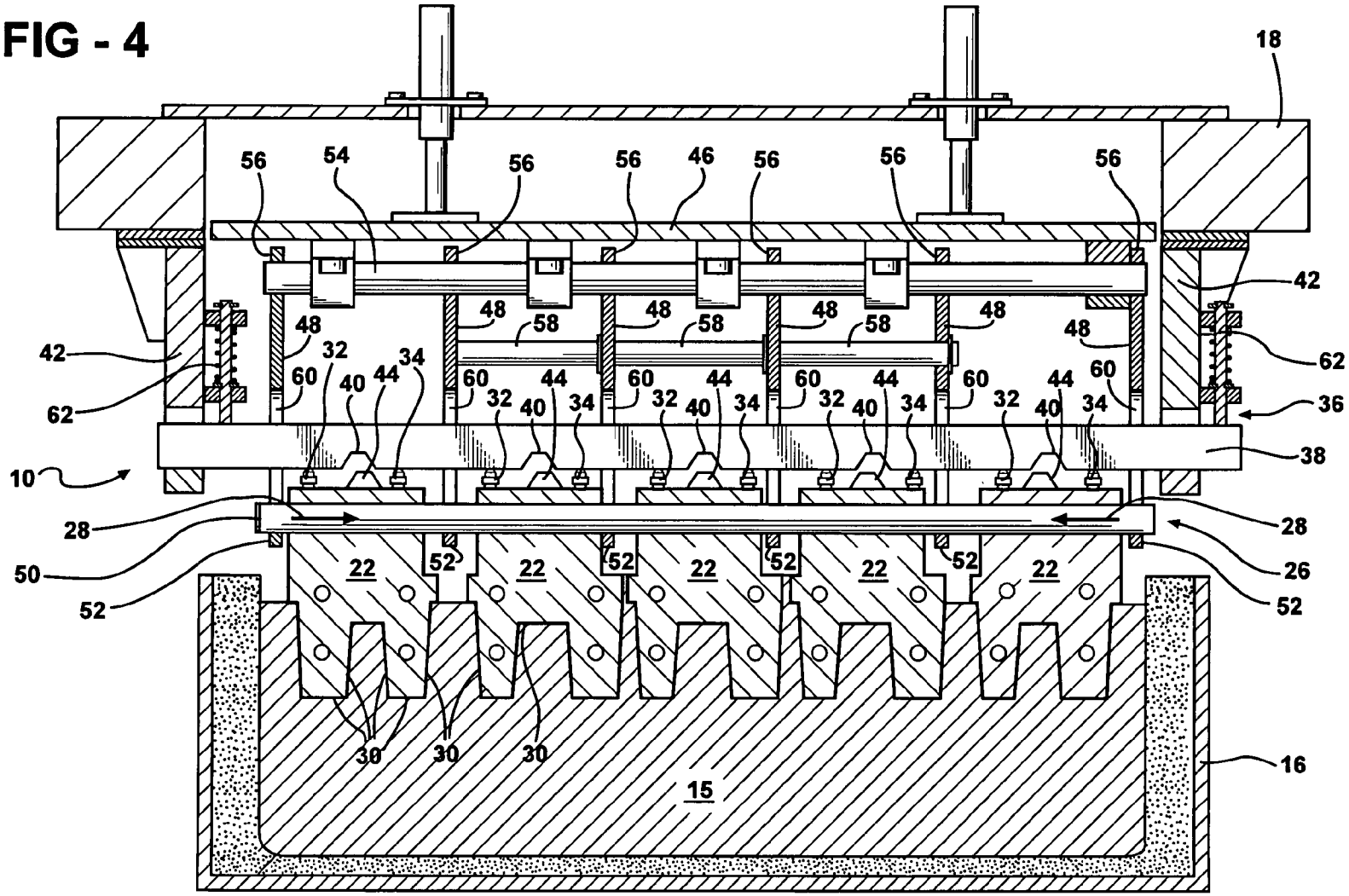
FIG. 4 is a cross-sectional view of the part beginning to be quenched such that the chills move in a X-direction from the pre-chill position to a post-chill position.
Figure 5:
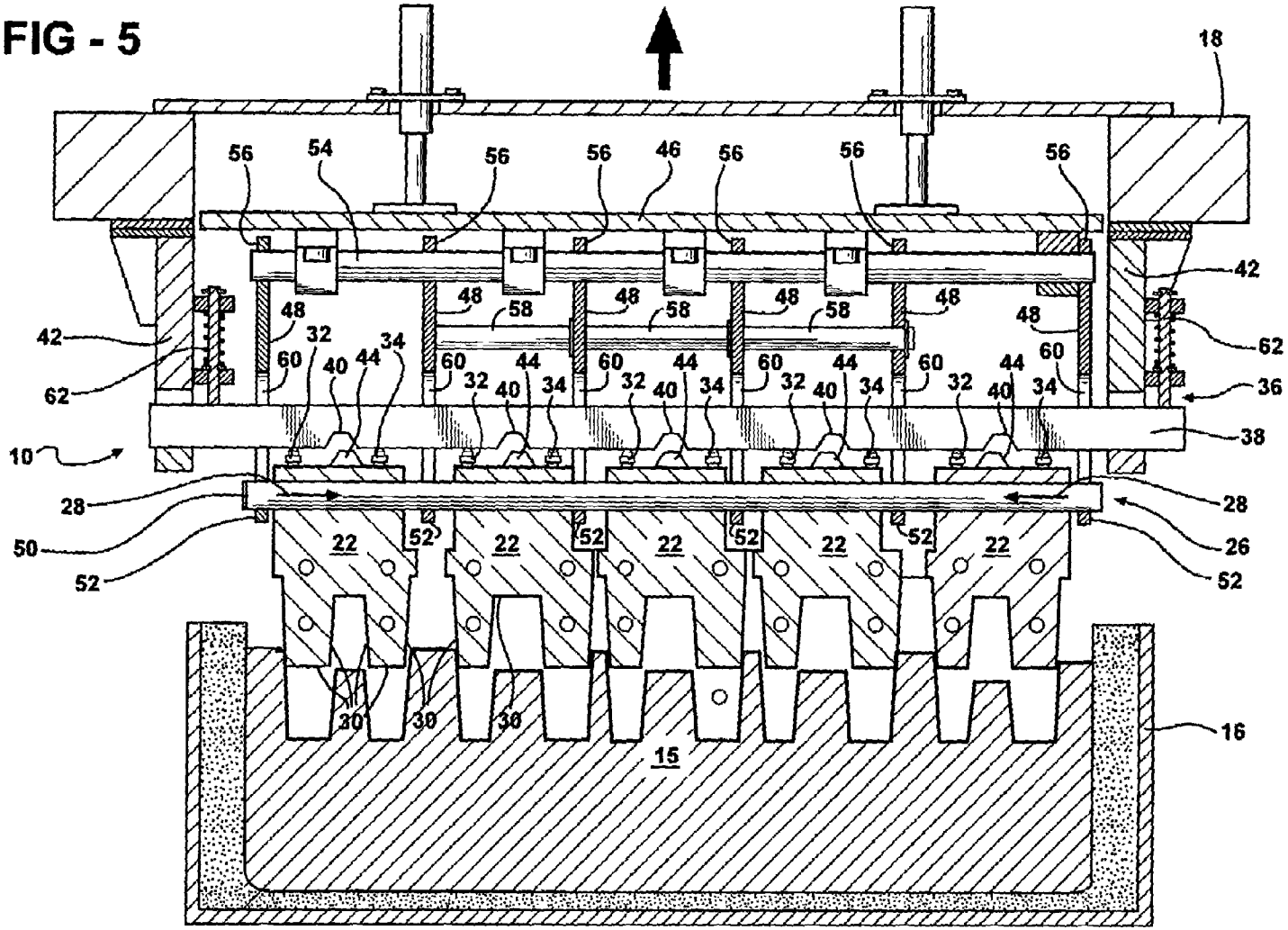
FIG. 5 is a cross-sectional view of the chilling assembly moved away from the mold platform with the chills engaging an alignment sub-assembly to re-align the chills in the pre-chill position.
Figure 6:
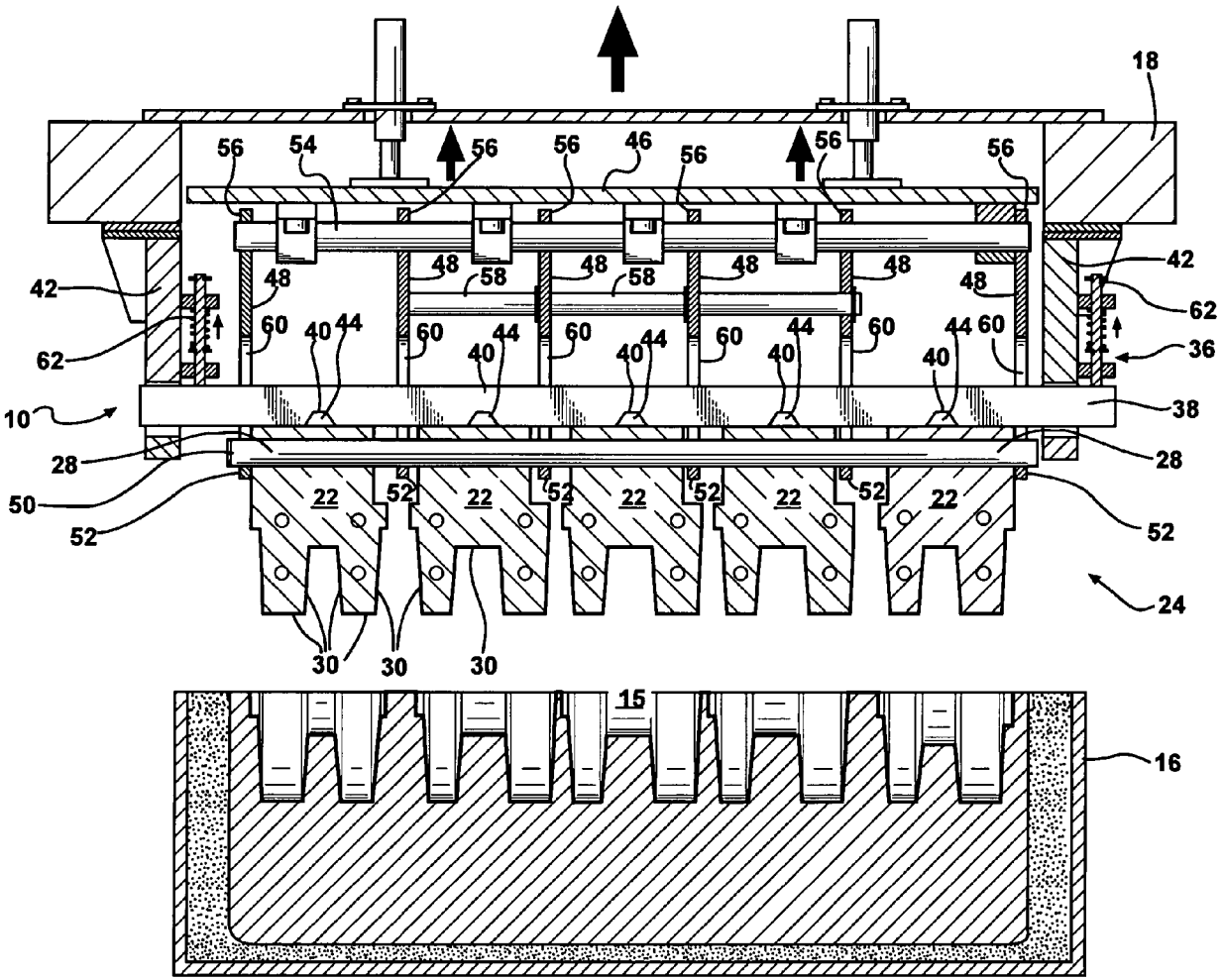
FIG. 6 is a cross-sectional view with the chills completely reset and re-aligned in the pre-chill position.
Figure 7:
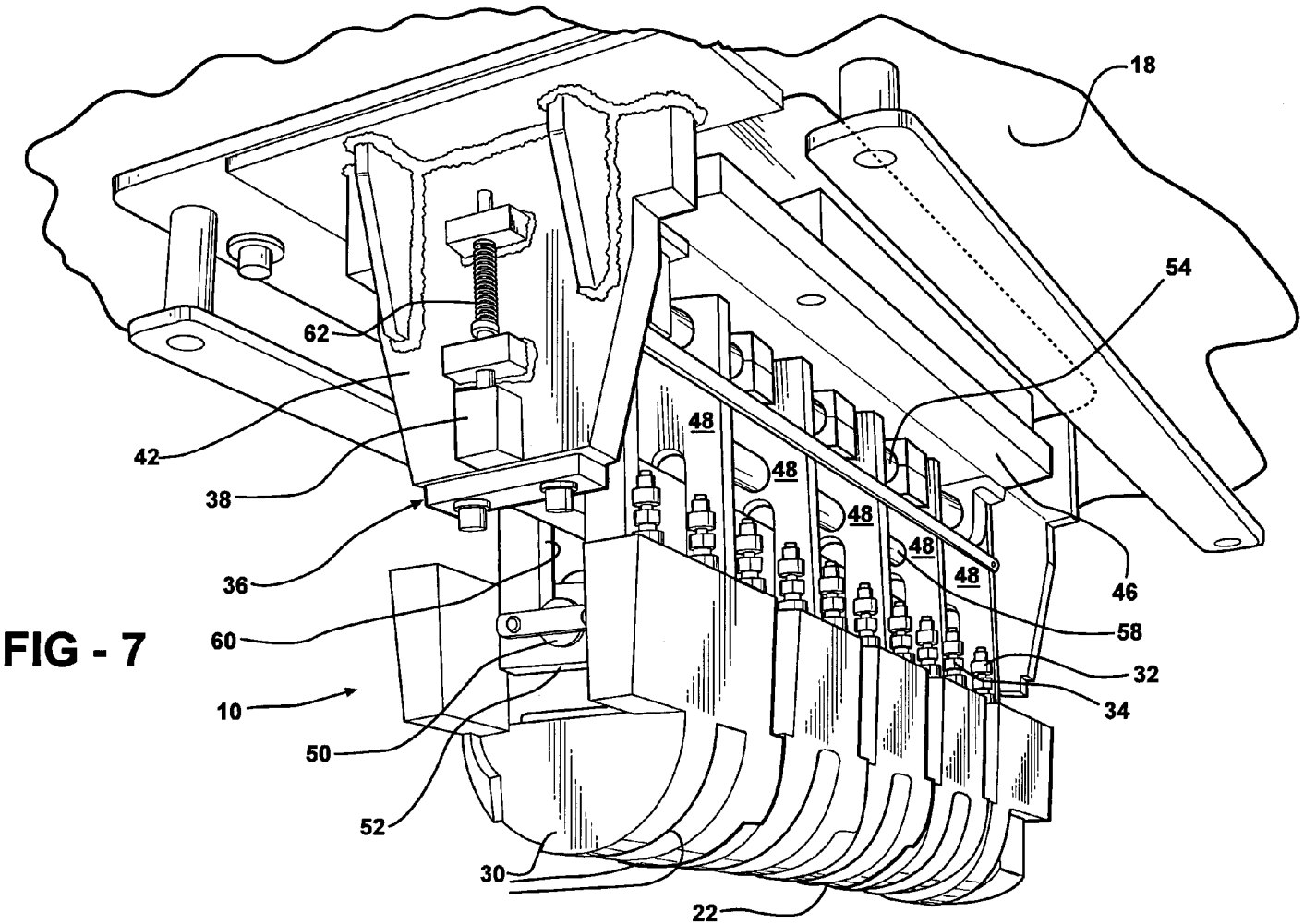
FIG. 7 is a perspective bottom view of the plurality of chills having a quenching surface for engaging the part.

Referring to FIG. 2, a plurality of chills 22 are moveably supported by the first platen 18 for quenching the molten material. Each of the chills 22 is moveable between a pre-chill position 24 and a post-chill position 26. The pre-chill position 24 is the position of the chills 22 prior to quenching the molten material as illustrated in FIGS. 2, 3, and 6. The post-chill position 26 is the position of the chills 22 after the part 15 has been quenched as illustrated in FIGS. 4 and 5. Each of the chills 22 is moveable along a X-direction 28 between the pre-chill 22 and the post-chill positions 26. When the chills 22 contact the molten material and begin to quench the molten material, the part 15 shrinks inward from each of the ends toward the center of the part 15. When the molten material is aluminum, the part 15 shrinks at a rate of about one-eighth of an inch per foot (⅛ inch per foot). Therefore, the rate of shrinkage at the center of the part 15 is less than the rate of shrinkage at the ends of the part 15. The inward shrinking of the molten material is defined as along the X-direction 28 and the chills 22 are able to move at the same rate that the part 15 is shrinking. Since the rate of shrinkage is different throughout the part 15, each of the chills 22 may move more or less depending upon the respective position in the part 15. For example, the chills 22 nearer the center of the part 15 will move very little, whereas the chills 22 nearer the ends of the part 15 will move more.

The chill 22 has a quenching surface 30 for engaging the molten material. The quenching surface 30, i.e., the surface that contacts the part 15 being cooled, includes the outer edge and surface, the inner walls, and the inner top surface of the chills 22. As should be appreciated, the quenching surface 30 of the present invention is inserted into the part 15 being cooled to cool a greater area than traditional techniques. The surface may be generally U-shaped as illustrated in the Figures. The portion of the part 15 being cooled, when contacted by this surface, has an increased strength compared to the rest of the part 15. Since the chills 22 can move in the X-direction 28, the chills 22 remain in contact with the surface longer so that the part 15 has increased strength over a larger area. The larger area, for the embodiment shown with a U-shaped quenching surface 30, radiates outward from the quenching surface 30 into the part 15.

To improve the quenching of the chills 22, each of the plurality of chills 22 has a cooling fluid inlet 32 and a cooling fluid outlet 34 for circulating a fluid (not shown) through the chill 22. The chill 22 can be any shape depending upon the type of part 15 to be formed. The cooling fluid lowers the temperature of the chills 22 and quenches the molten material. The cooling fluid may be any fluid capable of cooling the chills 22 and absorbing heat from the molten materials, such as, but not limited to, water.

An alignment sub-assembly 36 engages the chills 22 and aligns the chills 22 in the pre-chill position 24. The alignment sub-assembly 36 re-aligns the chills 22 after the chills 22 have quenched the molten material and have moved to the post-chill position 26. The alignment sub-assembly 36 must be capable of precisely aligning and re-aligning the chills 22 after each successive quenching of the molten material. Further, the alignment sub-assembly 36 must repeatedly position the chills 22 in the same pre-chill position 24 to ensure that the parts 15 are uniform and acceptable. In order to repeat the alignment and re-alignment, the alignment sub-assembly 36 includes a locator bar 38 supported by the first platen 18. The locator bar 38 defines a plurality of detents 40 corresponding to the pre-chill position 24. A pair of end caps 42 is disposed between the locator bar 38 and the first platen 18 to support the locator bar 38. A plurality of locators 44 are supported by the chills 22 such that the locators 44 engage the detents 40 to re-align the chills 22 in the pre-chill position 24.

In order to engage the locators 44 and the detents 40, the alignment sub-assembly 36 further comprises a second platen 46 moveable in the vertical direction independent of the first platen 18. The second platen 46 may be driven in the vertical direction by any known methods such as a motor or the lift 20. The second platen 46 supports the chills 22 and brings the locators 44 into engagement with the detents 40 for re-aligning the chills 22. The chills 22 are mounted to the second platen 46 by brackets 48. The chills 22 are slideably supported on a chill rod 50 that interconnects the chills 22 to the brackets 48. The chill rod 50 is at a lower end 52 of the brackets 48. The chills 22 are slideably supported on the chill rod 50 such that the chills 22 are capable of sliding in the X-direction 28. The X-direction 28 is preferably defined from the end of the part 15 towards a center of the part 15 when the part 15 is cooled such that the chills 22 on the outer ends of the chill rod 50 slide toward the chills 22 in the middle of the chill rod 50.

A bracket rod 54 is mounted to the second platen 46 and supports the brackets 48 at an upper end 56. Spacer posts 58 are mounted between the inner most brackets 48 maintain a distance therebetween. The brackets 48 move in unison with the second platen 46 to move the chills 22 vertical relative to the locator bar 38. The brackets 48 have slots 60 between the upper end 56 and the lower end 52 to allow for vertical movement about the locator bar 38, such that the locator bar 38 rides within the slots 60 and remains stationary relative to the brackets 48. The alignment sub-assembly 36 also includes a spring assembly 62 between the locator bar 38 and the first platen 18. The spring assembly 62 biases the locator bar 38 in a downward direction. The spring assembly 62 allows the locator bar 38 to flex when contacted by the locators 44. The flexing of the locator bar 38 reduces wear of both the locator bar 38 and the locators 44. In the preferred embodiment, the spring assembly 62 is mounted to at least one of the end caps 42.

The plurality of chills 22 are moved vertically by the vertical movement of the second platen 46 and the brackets 48. The locators 44 contact the locator bar 38 and re-align the chills 22 to the pre-chill position 24, while forcing the locator bar 38 against the downward force. This moves the individual chills 22 back to the pre-chill or original starting position after the shrinking of the part 15 moved them towards the center of the part 15 to the post-chill position 26.

The locator bar 38 flexes to prevent any damage to the detents 40 and the locators 44. Since the locator bar 38 is spring loaded, when the locators 44 engage the detents 40, the locator bar 38 is able to flex with vertical movement of the chills 22. This prevents the locator bar 38 from becoming damaged or from damaging the chills 22. If the locator bar 38 or chills 22 where damaged, or misaligned, then the part 15 to be formed may not meet the desired tolerances or specifications as a result of the chills 22 not being precisely aligned in the pre-chill position 24.

The subject invention further includes a mold package locator 64 mounted to the mold platform 14 for locating the mold relative to the first platen 18. The mold package 16 is positioned on the mold platform 14 using the mold package locator 64 to ensure that the mold package 16 will receive the chills 22 in the pre-chill position 24 for each one of the parts 15 to be formed. The mold package 16 may have wheels 66 for moving the mold package 16 onto the mold platform 14 prior to positioning with the mold package locator 64. However, the mold package 16 may be delivered to the mold platform 14 by other methods known to those skilled in the art.

The subject invention provides a method of forming the part 15 from molten material. Referring to FIG. 3, the method includes the steps of disposing the mold for the part 15 on the mold platform 14 adjacent the first platen 18. The plurality of chills 22 are supported by the second platen 46 and positioned in the pre-chill position 24 relative to the mold. When in the pre-chill position 24, the chills 22 are spaced from one another by a predetermined spacing. The first platen 18 is then moved into contact with the mold such that the chills 22 are positioned to quench the molten material as the molten material begins to cool to form the part 15. The molten material is injected into the mold and the material begins to flow into the mold package 16 and contacts the chills. The part 15 forms about the chills 22 as illustrated.

With reference to FIG. 4, the quenching action of the chills 22 causes the material forming the part 15 to shrink inwards from the ends towards the center of the part 15. This shrinkage moves the chills 22 from the pre-chill position 24 towards the center of the mold package 16 from each end. As illustrated, the chill 22 in the center of the part 15 moves little if at all. The chills 22 that are next adjacent the center moved toward the chill 22 in the center. The chills 22 farthest from the center moves the most toward the center. The predetermined spaced is reduced in the post-chill position 26.

Because the chills 22 can move with the shrinkage of the part 15, the area that is cooled on the part 15 radiates to a larger area and has increased strength characteristics. Those skilled in the art may recognize that since the chills 22 are able to move with the shrinkage of the part 15, the chills 22 remain in contact for a longer period of time. Without intending to be bound, it is believed that it is the longer period of time that increases the cooling and increases the strength. Also, because the chill 22 can move with the shrinkage of the part 15, the chills 22 are less likely to become wet with the material and can therefore be removed when the quenching is complete and before the part 15 has finished processing. As the chills 22 remain in contact with the molten material, the cooling fluid is being pumped through the chills 22 to increase the quenching.

As shown in FIG. 5, once quenching is complete, the chills 22 end in the post-chill position 26 set inwards from the ends of the part 15 and the first platen 18 is moved out of contact with the mold to remove the chills 22 from the molten material. It is to be appreciated that the chills 22 may be removed from the part 15 as soon as the part 15 attains a semi-solid state. The semi-solid state may be have a solid skin formed about the part such that interior portions of the part may remain in the molten state. The part 15 does not have to be completely formed prior to removing the chills 22. Moreover, after the chills 22 are removed, the semi-solid part may be subject to a spraying with a fluid to further quench the part 15. The fluid may be water, air, or any other fluid capable of dissipating heat from the semi-solid part 15. The spraying rapidly forms the part 15 and further improves the physical characteristics of the part 15.

Next, the chills 22 are re-aligned from the post-chill position 26 to the pre-chill position 24. The re-alignment is done automatically upon removing the chills 22 from the mold. Therefore, little or no user intervention is required and the chills 22 are precisely aligned for each successive part 15 to be formed. In FIG. 6, the second platen 46 is moved independent of the first platen 18 in the upward direction causing the locators 44 to move toward the detents 40 of the locator bar 38. The locators 44 are shown being received in the detents 40 in FIG. 6. The locator bar 38 engages the locators 44 mounted to the chills 22 which slides the chills 22 outward to the pre-chill position 24, which is the position the chills 22 were in before the shrinkage of the part 15 moved them inwards to the post-chill position 26. The chills 22 are then re-aligned from the post-chill position 26 to the pre-chill position 24. When the locators 44 engage the locating bar, the locator bar 38 flexes to overcome the biasing force of the spring assembly 62 to prevent wear and damage.

While the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A chill assembly for chilling a molten material during formation of a part, said assembly comprising:

a mold platform for receiving a mold to be filled with a molten material to form a part;

a first platen moveable in a vertical direction relative to said molding platform;

a plurality of chills moveably supported by said first platen for quenching the molten material with each of said chills being moveable between a pre-chill position prior to quenching and a post-chill position after quenching; and an alignment sub-assembly disposed between said first platen and said chill, wherein said alignment sub-assembly engages with said chills for aligning said chills in said pre-chill position after said chills have quenched the molten material and after said chills have moved to said post-chill position.

2. A chill assembly as set forth in claim 1 wherein said alignment sub-assembly further comprises a locator bar supported by said first platen defining a plurality of detents corresponding to said pre-chill position.

3. A chill assembly as set forth in claim 2 wherein said alignment sub-assembly further comprises a plurality of locators supported by said chills such that said locators engage said detents to re-align said chills in said pre-chill position.

4. A chill assembly as set forth in claim 3 wherein said alignment sub-assembly further comprises a second platen supporting said chills and moveable in said vertical direction independent of said first platen.

5. A chill assembly as set forth in claim 4 wherein said alignment sub-assembly further comprises a spring assembly between said locator bar and said first platen to allow said locator bar to flex and to reduce wear.

6. A chill assembly as set forth in claim 5 further comprising a pair of end caps disposed between said locator bar and said first platen for supporting said locator bar.

7. A chill assembly as set forth in claim 6 wherein said spring assembly is mounted to at least one of said end caps.

8. A chill assembly as set forth in claim 4 further comprising brackets interconnecting said second platen and said chills to move said chills vertical relative to said locator bar.

9. A chill assembly as set forth in claim 8 further comprising a chill rod slideably supporting said chills and said brackets.

10. A chill assembly as set forth in claim 1 wherein said chills are liquid cooled.

11. A chill assembly as set forth in claim 10 wherein each of said plurality of chills have an inlet and an outlet for receiving a cooling liquid to quench the molten material.

12. A chill assembly as set forth in claim 1 wherein said chills are moveable along a X-direction between said pre-chill and said post-chill positions.

13. A chill assembly as set forth in claim 1 further comprising a lift in engagement with said first platen for driving said first platen upward and downward in said vertical direction.

14. A chill assembly as set forth in claim 1 further comprising a package locator mounted to said mold platform for locating the mold relative to said first platen.

15. A chill assembly as set forth in claim 1 further comprising an upper platform supporting said first and said second platens relative to said mold platform.

16. A method of forming a part from molten material, said method comprising the steps of:

disposing a mold for a part on a mold platform adjacent a first platen;

positioning a plurality of chills supported by a second platen in a pre-chill position relative to the mold;

moving the first platen into contact with the mold such that the chills quench the molten material as the molten material begins to cool to form the part;

injecting a molten material into the mold;

moving the plurality of chills along a X-direction simultaneously with a shrinkage occurring in the part as the molten material cools such that the chills end in a post-chill position;

moving the first platen out of contact with the mold to remove the chills from the molten material; and re-aligning the plurality of chills from the post-chill position to the pre-chill position.

17. A method as set forth in claim 16 wherein the step of re-aligning the plurality of chills is further defined as automatically re-aligning the chills upon removing the chills from the mold.

18. A method as set forth in claim 16 wherein the step of re-aligning the plurality of chills further comprises the step of moving the second platen independent of the first platen to re-align the chills in the pre-chill position.

19. A method as set forth in claim 18 wherein the step of re-aligning the plurality of chills further comprises the step of engaging a locator bar supported by the first platen with locators mounted to the chills to re-align the chills in the pre-chill position.

20. A method as set forth in claim 18 further comprising the step of biasing the locator bar in a downward direction to allow the locator bar to flex when engaging the locators.

21. A chill assembly for chilling a molten material during formation of a part, said assembly comprising:

a mold platform for receiving a mold to be filled with a molten material to form a part;

a first platen moveable in a vertical direction relative to said molding platform; and a plurality of chills moveably supported by said first platen for quenching the molten material with each of said chills being moveable with the shrinkage of a molten metal between a pre-chill position prior to quenching and a post-chill position after quenching, wherein said chills are liquid cooled.

22. A chill assembly as set forth in claim 21 wherein each of said plurality of chills have an inlet and an outlet for receiving a cooling liquid to cool said chills to quench the molten material.

23. A chill assembly as set forth in claim 21 wherein said chills are moveable along a X-direction between said pre-chill and said post-chill positions.

24. A method of forming a part from molten material, said method comprising the steps of:

disposing a mold for a part on a mold platform adjacent a first platen;

positioning a plurality of chills supported by a second platen in a pre-chill position relative to the mold;

moving the first platen into contact with the mold such that the chills quench the molten material as the molten material begins to cool to form the part;

injecting a molten material into the mold;

moving the plurality of chills along a X-direction simultaneously with a shrinkage occurring in the part as the molten material cools such that the chills end in a post-chill position;

moving the first platen out of contact with the mold to remove the chills from the molten material after the part attains a semi-solid state; and spraying the part while in the semi-solid state with a fluid to promote additional cooling of the molten material with the chill being removed therefrom.

25. A method as set forth in claim 24 wherein the step of spraying the part is further defined as spraying the part with water.

26. A method as set forth in claim 24 wherein the step of spraying the part is further defined as spraying the part with water.

* * * * *